US010119322B2

(12) United States Patent
Carullo et al.

(10) Patent No.: US 10,119,322 B2
(45) Date of Patent: Nov. 6, 2018

(54) ELECTRONIC SAFES AND HINGE MECHANISMS FOR ELECTRONIC SAFE

(71) Applicant: Ellenby Technologies, Inc., Woodbury Heights, NJ (US)

(72) Inventors: Thomas Carullo, Marlton, NJ (US); Aaron H. Dobbins, Cherry Hill, NJ (US)

(73) Assignee: Ellenby Technologies, Inc., Woodbury Heights, NJ (US)

( * ) Notice: Subject to any disclaimer, the term of this patent is extended or adjusted under 35 U.S.C. 154(b) by 272 days.

(21) Appl. No.: 15/142,548

(22) Filed: Apr. 29, 2016

(65) Prior Publication Data

US 2017/0058590 A1 Mar. 2, 2017

Related U.S. Application Data

(60) Provisional application No. 62/210,719, filed on Aug. 27, 2015.

(51) Int. Cl.

| | |
|---|---|
| ***E05D 7/14*** | (2006.01) |
| ***E05G 1/026*** | (2006.01) |
| ***E05D 3/04*** | (2006.01) |
| ***G07D 11/00*** | (2006.01) |
| *E05D 3/02* | (2006.01) |

(52) U.S. Cl.

CPC ..... *E05G 1/026* (2013.01); *E05D 3/04* (2013.01); *E05D 7/14* (2013.01); *G07D 11/0003* (2013.01); *E05D 2003/025* (2013.01); *E05Y 2600/452* (2013.01); *E05Y 2600/51* (2013.01); *E05Y 2600/54* (2013.01); *E05Y 2900/21* (2013.01)

(58) Field of Classification Search

CPC ... E05B 1/00; E05B 1/02; E05B 1/026; E05B 1/06; E05D 7/14

See application file for complete search history.

(56) References Cited

U.S. PATENT DOCUMENTS 1,865,052 A * 6/1932 Wolters ..... E05D 7/14 16/263
2,062,417 A * 12/1936 Jay ..... E05G 1/026 109/47
4,539,828 A * 9/1985 Teleky ..... E05B 17/2088 70/369
4,704,970 A * 11/1987 Sanderson ..... E05D 7/14 109/73
4,979,264 A * 12/1990 Ramsauer ..... E05D 7/10 16/264

(Continued)

*Primary Examiner* — Christopher J Boswell

(74) *Attorney, Agent, or Firm* — Hultquist, PLLC; Peter H. Priest

(57) ABSTRACT

An electronic safe and hinge combination is addressed in which hinges are integrally formed from a door plate and safe wall plate, such as a safe side wall. No exterior welds are employed so that a strong and aesthetically pleasing fascia results. Additionally, a hinge and removable hinge pin arrangement is provided which allows the safe body to be constructed separately from the doors and mated together during final assembly, as well as, facilitating repair of a damaged door and retrofitting one door for another for an in the field upgrade. An electronic drop safe is described employing two or more doors and mounted to a safe having a sidewall with an integrally formed hinge.

10 Claims, 9 Drawing Sheets

(56) References Cited

U.S. PATENT DOCUMENTS

| | | | | |
|---|---|---|---|---|
| 5,666,695 | A * | 9/1997 | Jegers | E05D 7/1022 16/380 |
| 5,931,104 | A | 8/1999 | Horn et al. | |
| 5,971,515 | A | 10/1999 | Baker et al. | |
| 6,308,396 | B1 * | 10/2001 | Lewis | E05B 65/0075 29/464 |
| 7,350,470 | B1 | 4/2008 | Stuhlbarg et al. | |
| 7,516,832 | B2 | 4/2009 | Dobbins | |
| 7,779,983 | B2 | 8/2010 | Dobbins | |
| 8,770,372 | B2 | 7/2014 | Dobbins et al. | |
| 9,142,079 | B2 | 9/2015 | Dobbins et al. | |
| 9,732,549 | B2 * | 8/2017 | Chow | E05G 1/026 |
| 2008/0116216 | A1 * | 5/2008 | Farrar | E05D 11/0027 220/836 |
| 2011/0279225 | A1 | 11/2011 | Frontino et al. | |
| 2016/0110939 | A1 | 4/2016 | Dobbins et al. | |
| 2016/0210801 | A1 | 7/2016 | Dobbins | |

* cited by examiner

ELECTRONIC SAFES AND HINGE MECHANISMS FOR ELECTRONIC SAFE

The present application claims the benefit of U.S. Provisional Application Ser. No. 62/210,719 filed on Aug. 27, 2015 which is incorporated by reference herein in its entirety.

FIELD OF THE INVENTION

The present invention relates generally to more secure and aesthetically pleasing hinge mechanisms for electronic safes, and more particularly to methods for forming and assembling a safe door or doors with integral hinge knuckles to a safe wall with integrally formed hinge knuckles, as well as, an advantageous hinge and removable hinge pin arrangement.

BACKGROUND OF THE INVENTION

In safes in general, a hinge mechanism which allows a safe door to swing open after being unlocked provides a potential weak point for a potential attack on that safe. More particularly, in electronic drop safes used to store excess cash at businesses such as convenience stores, and the like, a hinge construction may be both more costly and less protective than desired.

For example, in one electronic drop safe construction 100, shown in the back cutaway view of FIG. 1A and in the front perspective view of FIG. 1B. Commercial hinges are used having flanges, 110 and 112. A flange 110 is welded to the side wall 120 and the flange 112 is welded to the door 130 of a safe 100. A first series of welds 132, 134, 136, 138 and 140 weld the flange 110 to the side wall 120. A second series of welds 142, 144, 146, 148 and 150 weld the flange 112 to the doors 130 and 150. External welds for door 160 are not seen in FIG. 1A.

As seen in FIG. 1B, an alternate series of external welds 152, 154 and 156 are also preferably employed between hinge knuckles 153, 155 and 157 of the door 130 to prevent attempts to forcibly attack the hinges by unrolling them using a pry bar, for example. External welds 171 and 173 are also employed between hinge knuckles 170 and 172, respectively, and side wall 120. Similar welds are seen for the knuckles of doors 150 and 160 in FIG. 1B. Alternatively, the commercial hinge can be mounted on the outside of the door and safe wall. In this case, not shown, the hinge flanges are welded on the outside of the safe further negatively impacting the aesthetics and increasing the overall volume of the safe without any advantage to the customer from the added volume. The hinge knuckles still need to be welded to secure them against attempts to unroll them.

The flange based hinge approach described above has an undesirable cosmetic appearance as a result of all the external welds as seen in FIG. 1B, as well as, having an increased manufacturing cost as a result of the extra cost resulting from welding the flanges 110 and 112 to the safe and the door, respectively.

FIG. 2 shows an alternative prior art electronic drop safe 200 with a much larger hinge arrangement in which a large hinge member 205 is welded to door 230 and swingingly mates with a similar large hinge member 215 welded to edge 240 of the front wall of the electronic safe 200. Additional hinge member pairs extend along the edge 240. While looking heavy and strong, the approach shown presents a point of attack for those intent upon trying to rob safes such as the electronic safe 200. Further details are not provided in the interest of not educating the unscrupulous.

U.S. Pat. No. 7,350,470 addresses integrating a hinge directly into the door and side wall of a plastic safe so as to make it substantially more difficult to forcibly break the hinges and gain access into a safe. However, the approach disclosed relies on a single hinge column with a bore hole extending its entire length, as well as, the use of two spring-loaded pivoting rods that only engage a short way into the top and bottom of the hinge. The hinge pins are only retained at the very top and very bottom of the safe housing which potentially allows a burglar to generate substantial force at the top and bottom of the safe by prying the door at the center. Further, it is unclear how the door may be removed once the spring loaded pins are inserted into the hinge door without destroying the door or the safe body. A similar pin arrangement is taught by U.S. Pat. No. 5,931,104 using a sheet metal door with cobalt alloy bar stock pins and a compression sleeve.

U.S. Pat. No. 5,971,515 addresses rolling a hinge directly into the door of a safe and hiding the hinge completely from view. The hinge is formed completely from the door. Knuckles extending the full length of the door are affixed to a small flange welded to an interior sidewall of the safe. This arrangement uses a portion of the internal volume of the safe housing to keep the hinge hidden from view disadvantageously leaving less room to store valuables or other security related hardware inside the safe. The disclosed approach also welds the fixed leaf of the hinge to the front surface of the safe in a manner in which the welds would be cosmetically visible.

SUMMARY OF THE INVENTION

To address such issues, as well as reducing the number of parts, one aspect of the present invention addresses an arrangement in which hinge knuckles are formed as integral parts of both the door and the sidewall of a safe. Among its several advantages, this approach eliminates unsightly exterior welds resulting in a more visually pleasing product. It also eliminates all welds associated with the flanges used in commercial hinges. The costs of such welds to attach the alternative commercial hinges to both the door and side wall of the safe are eliminated while providing superior strength with a reduction in possible access points for attacking the safe.

Further, in one embodiment, an arrangement is provided in which a removable hinge pin is employed in conjunction with hinges such as those addressed above and further herein.

In one embodiment, a hinge and removable pin arrangement is employed in combination with an electronic drop safe having at least two doors. A first door, for example, provides access to a banknote validator, and a second door, for example, provides access to banknote storage of the electronic safe. A third door may suitably be employed for insertion of items, such as envelopes or the like, for example. A typical electronic drop safe in accordance with this embodiment is typically used to store excess cash at businesses as convenience stores, and the like, and is bolted or otherwise secured to the floor underneath a counter near a checkout location. The banknote validator validates excess cash inserted into the electronic drop safe and validated banknotes are stored in a banknote stacker.

The ability to remove the hinge pin from a safe, such as an electronic drop safe having hinges as taught herein, affords several benefits. First, in manufacturing, the safe body can be constructed separately from the doors and mated together during final assembly. This construction approach allows for more even paint application to the body of the safe and the doors than could otherwise be applied if the two parts needed to be permanently trapped together prior to painting. Secondly, if a door is damaged during manufacturing, shipping, or field use by the customer, only the damaged component needs to be replaced rather than costly rework needing to be performed to the entire safe. By way of example, such rework might include cutting a hinge or hinges off, or otherwise removing the hinge, removing and replacing a door with a new hinge, rewelding and refinishing including grinding, surface prep and painting. As such, it can quickly become prohibitively expensive to replace even one door. Thirdly, having a removable hinge pin allows for the reconfiguration of a safe, such as a two or more door electronic drop safe, after it is manufactured. The door design defines many importantly available configurations available to the customer such as the use of key locks or electronic locks, the security of the boltwork, user interface accessories, and drop slots. Having the ability to change out the doors allows for dramatic safe feature reconfigurations and field upgrades.

A more complete understanding of the present invention, as well as further features and advantages of the invention, will be apparent from the following Detailed Description and the accompanying drawings.

DETAILED DESCRIPTION OF THE INVENTION

Examples of electronic safes in which the present invention may suitably be employed in combination include those shown and described in U.S. Pat. Nos. 7,516,832; 7,779,983; and 8,770,372 and U.S. application Ser. Nos. 13/105,951; 14/293,431; 14/515,788; and 14/598,337 all of which are incorporated by reference herein in their entirety with respect to their further details concerning electronic safes and electronic drop safes, respectively.

Figure 3B:
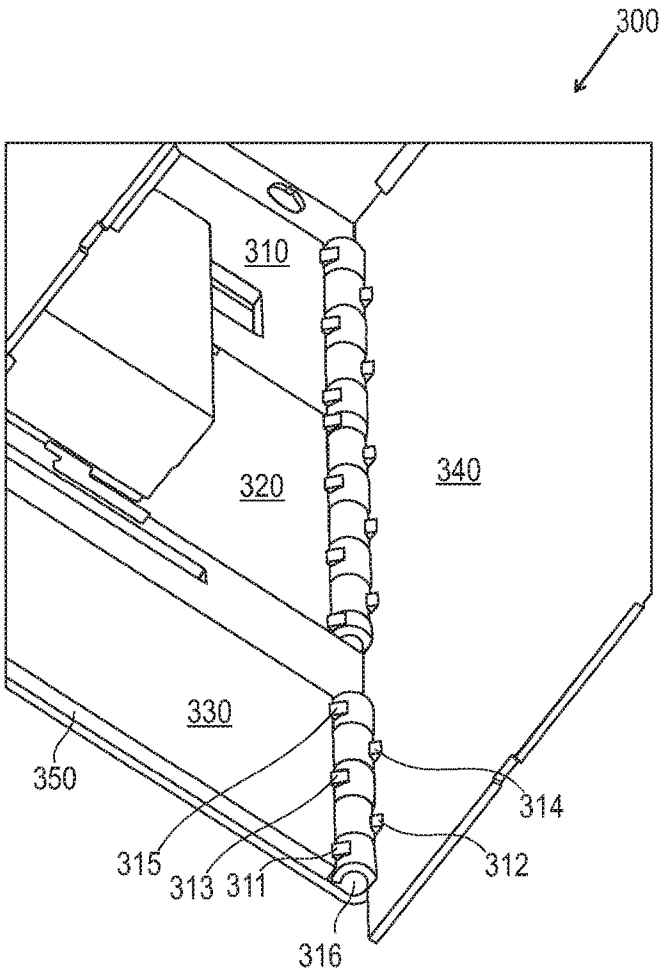
FIGS. 3A and 3B illustrate aspects of an embodiment of an electronic drop safe and hinge combination in accordance with a first aspect of the present invention.
Figure 3A:
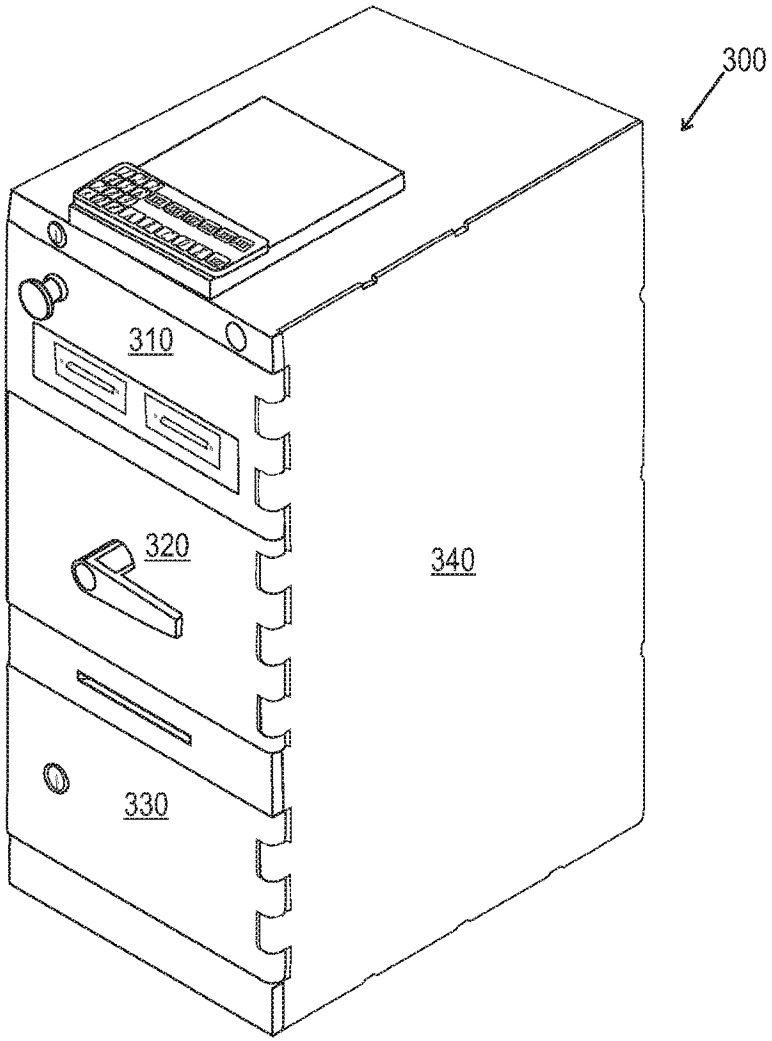

As seen in the perspective front view of FIG. 3A, an electronic drop safe and hinge combination 300 of the present invention presents a sleek, eye appealing appearance in which exterior welds have been eliminated. As discussed further below, the hinges for the safe doors 310, 320 and 330 are formed directly in these doors and wall 340 of the electronic safe 300. By way of example, door 310 may provide access to service a pair of bill validators for validating currency inserted into the electronic safe. Door 320 may provide access to currency stackers which stack currency validated by said bill validators. Door 330 may provide access to materials deposited through a slot in envelopes, for example.

In the cutaway perspective view of FIG. 3B, alternating welds 311, 313, 315, 312 and 314 are employed to provide added strength. The welds 311, 313 and 315 help prevent their respective door knuckles from being unrolled, and the welds 312 and 314 help their respective side wall knuckles from being unrolled. Additional welds not numbered have the same function for further knuckles for doors 320 and 330, as well as, mating knuckles in side wall 340 as illustrated in FIG. 3B. A hinge pin 316 is inserted through the mating knuckles and secured from access upon installation of a ceiling or roof to the safe.

Figure 1B:
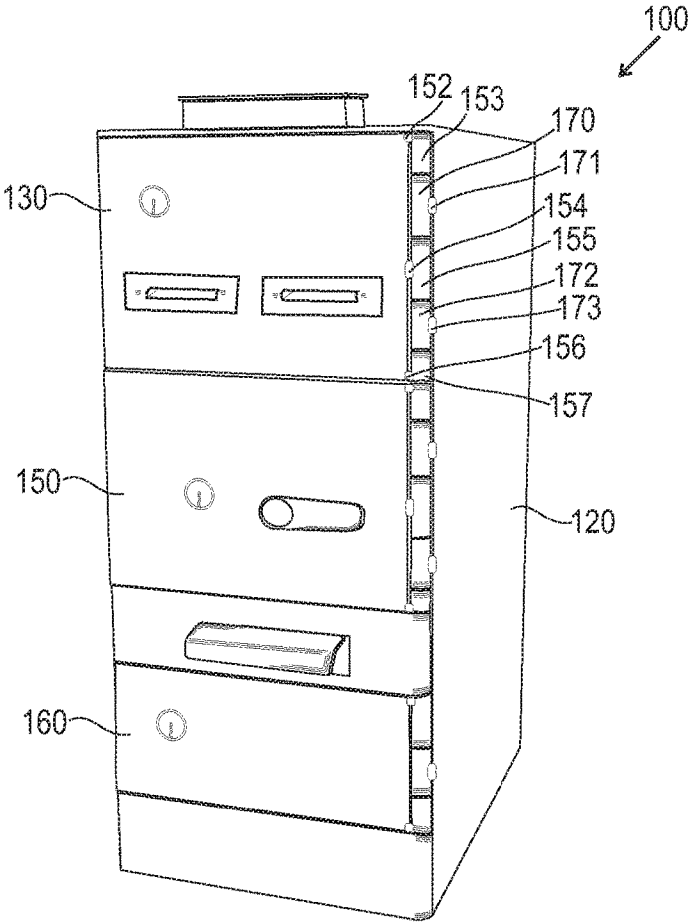
FIG. 1B PRIOR ART
FIGS. 1A and 1B show a first prior art hinge approach in an electronic drop safe.
Figure 1A:
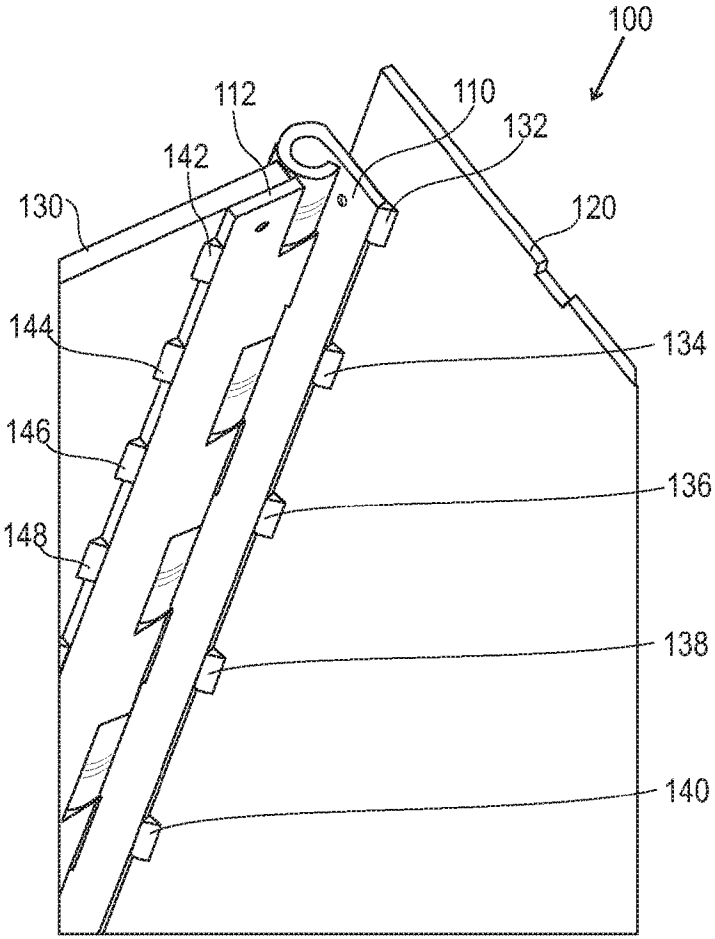
FIG. 1A PRIOR ART
Figure 2:
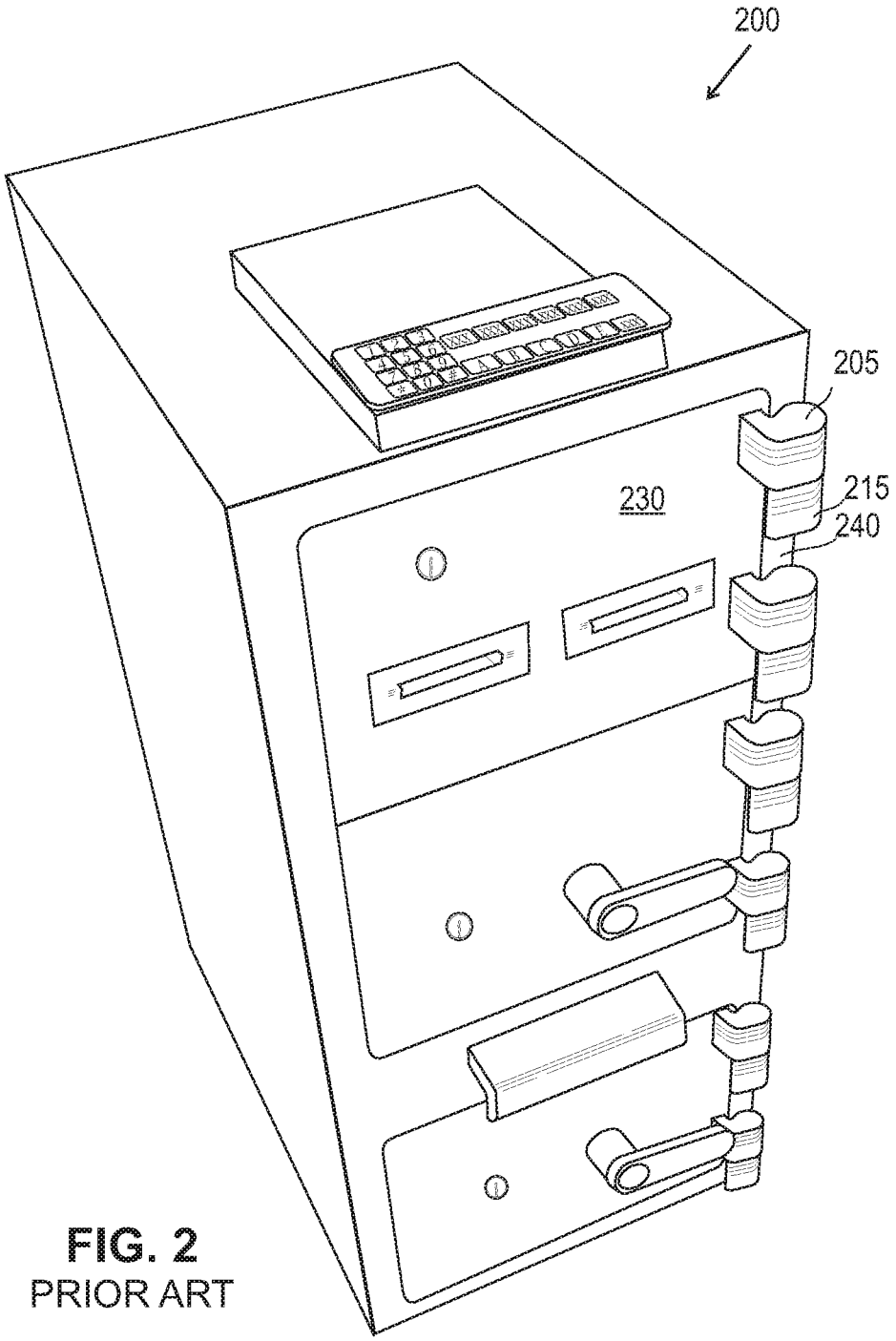
FIG. 2 PRIOR ART
FIG. 2 shows a perspective view of a second prior art electronic drop safe employing a second hinge approach.

In summary, the arrangement shown in FIGS. 3A and 3B provides an advantageous arrangement in which the hinge is formed directly and integrally in the side wall 340 and doors 310, 320 and 330 to provide superior strength with respect to the flange based approach of FIGS. 1A and 1B. In the embodiment shown, all exterior welds are eliminated presenting a more aesthetically pleasing fascia with respect to either of the approaches of FIGS. 1A and 1B or FIG. 2, while still providing the added strength provided by internal welds to the knuckles, as well as, a fascia having a reduction in the number of possible points of attack with respect to the approach of FIG. 2. Further, the internal welds to strengthen the knuckles of the doors 310, 320 and 330, such as the exemplary welds 311, 313 and 315 can also advantageously serve the dual purpose of welding a reinforcing plate 350 in place, as seen in FIG. 3B.

Figure 4B:
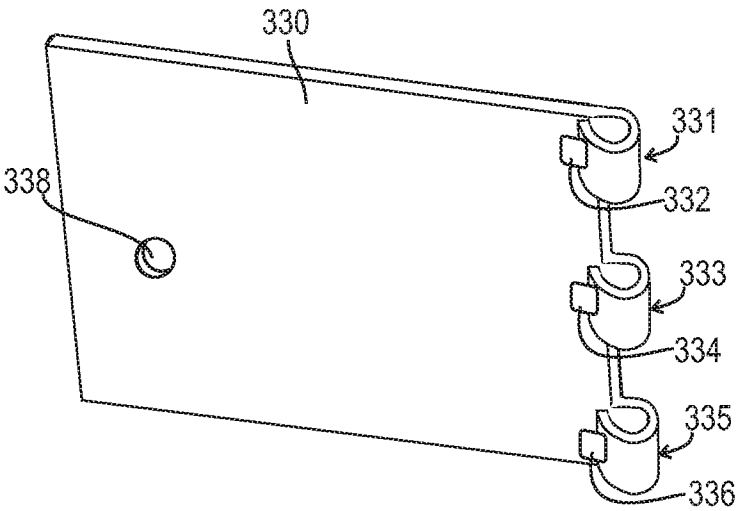
FIGS. 4A and 4B illustrate a back view of a back surface of an exemplary door plate which faces the interior of the safe upon installation with integral fingers for forming hinge knuckles and the door plate where those hinges have been rolled into hinge knuckles and welded in place, respectively, suitably employed in the embodiment of FIGS. 3A and 3B.
Figure 4A:
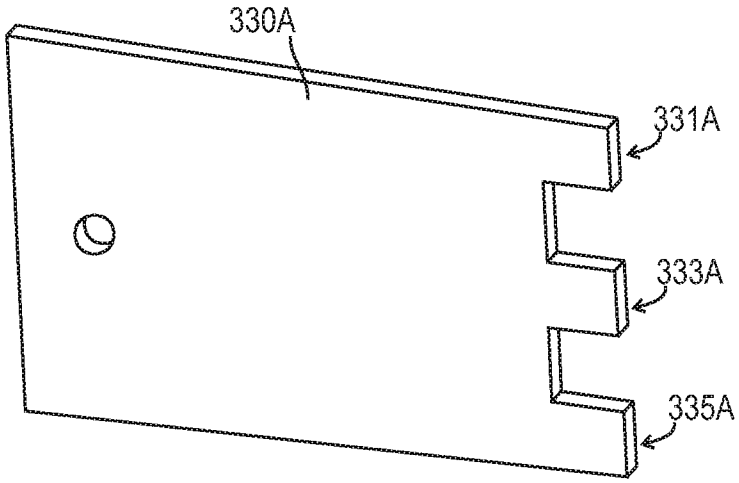

FIG. 4A shows a front view of a blank of steel plate 330A from which the door 330 can be formed as follows. As seen in FIG. 4A, the blank 330A has three fingers 331A, 333A and 335A from which knuckles 331, 333 and 335 are formed, as seen in FIG. 4B which shows a back view of a partially finished door 330 without a lock installed in lock hole 338, by rolling the fingers around a circular rod of the correct diameter as part of the manufacturing process. Once the knuckles 331, 333 and 335 are formed, they are reinforced by welds 332, 334 and 336, respectively, which are on the back surface of the door 330 which faces the interior of the safe upon installation so that they are not externally visible when door 330 is closed.

Figure 5B:
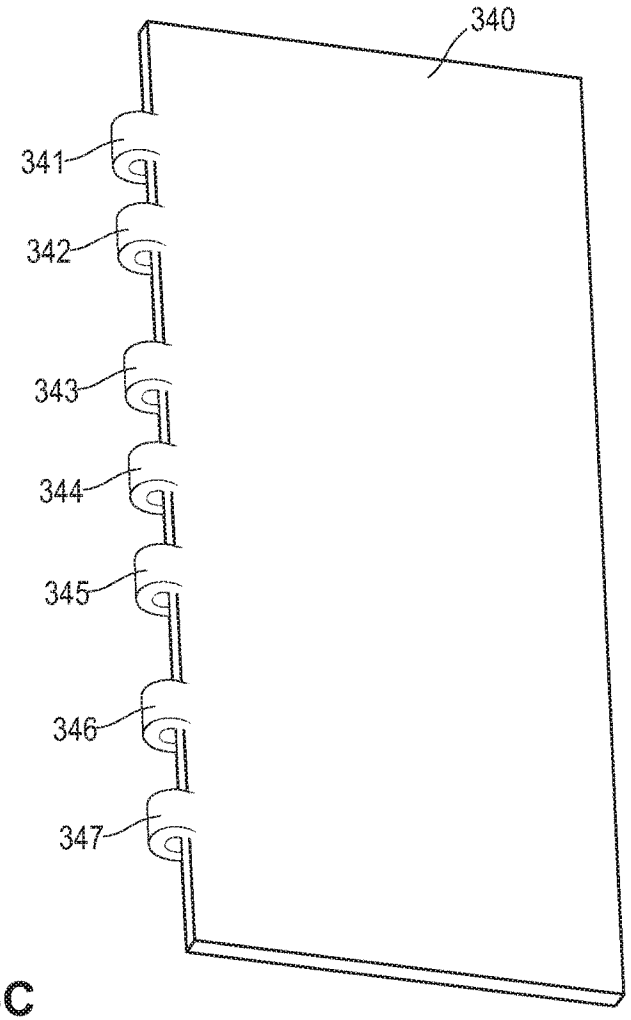
FIGS. 5A, 5B and 5C illustrate a safe wall with integral fingers for forming hinge knuckles, and the same pieces with the hinges rolled and welded in place to form knuckles which mate with those shown in FIG. 4B, respectively, and suitably employed in the embodiment of FIGS. 3A and 3B.
Figure 5C:
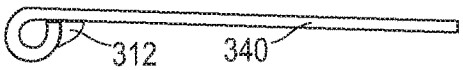
Figure 5A:
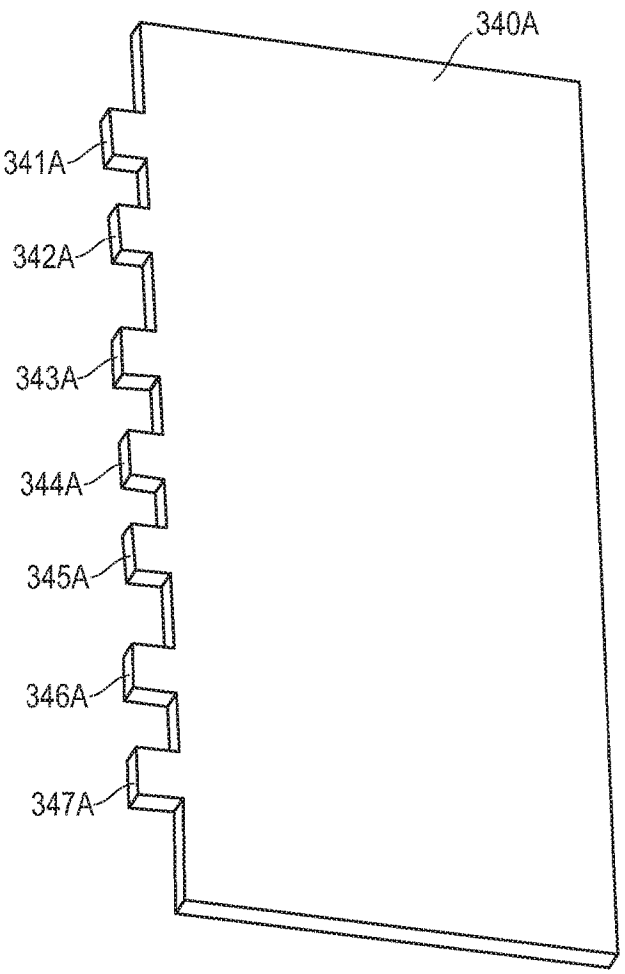

FIG. 5A shows a perspective view of a blank of steel 340A from which the side wall 340 can be formed as follows. As seen in FIG. 5A, the blank 340A has seven fingers 341A, 342A, 343A, 344A, 345A, 346A and 347A from which knuckles 341, 342, 343, 344, 345, 346 and 347 are formed as seen in FIG. 5B which shows a view of the exterior surface of a partially finished side wall 340. The knuckles are preferably formed with progressive tool sets for press brakes to achieve the correct diameter as part of the manufacturing process, but it will be recognized other manufacturing techniques might be employed. Once the knuckles are formed, they are reinforced by welds 312, 314 and so on as seen in FIGS. 3B and 5C, respectively, which are on the internal surface of the side wall 340. FIG. 5C shows an edge view illustrating internal weld 312, one of the series of internal welds addressed above.

Figure 6:
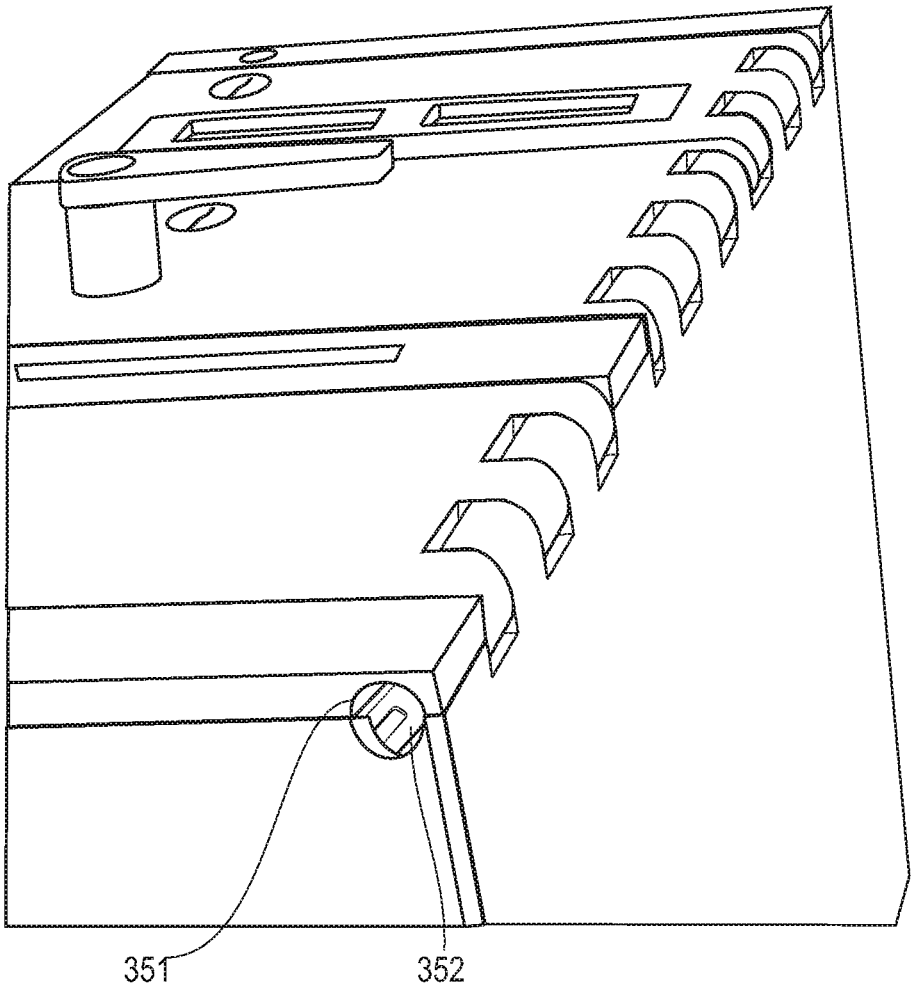
FIGS. 6, 7 and 8 illustrate aspects of how the hinge pin can be configured to be removable from an electronic drop safe, such as the embodiment of FIGS. 3A and 3B.
Figure 7:
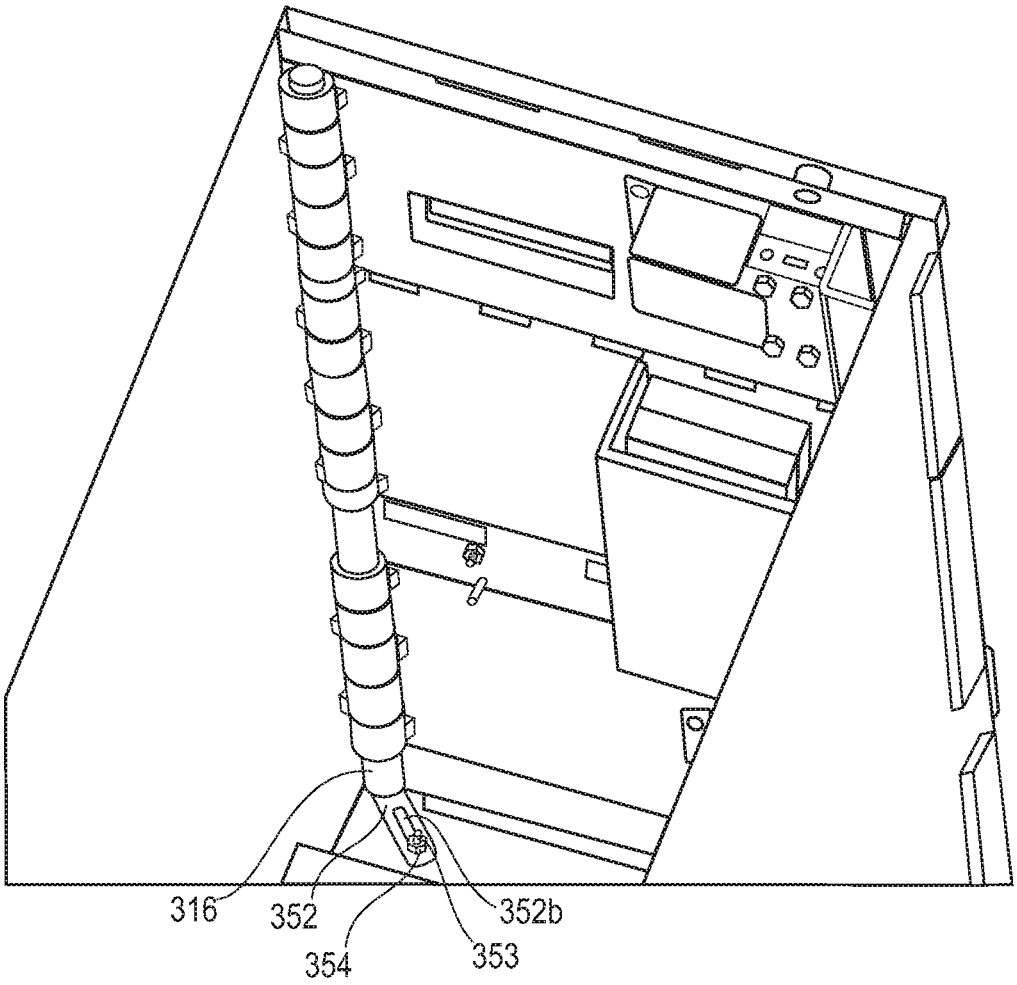

FIG. 6 shows a bottom perspective view of the electronic drop safe and hinge combination 300 illustrating a bottom access hole 351 underneath a removable hinge pin 316 (seen in FIGS. 7 and 8) to provide access thereto. The hinge pin 316 sits on top of a slideable platform 352 to prevent removal of the hinge pin out the bottom access hole 351, as best seen in FIG. 7. The platform is secured in place with a stud 353 fastened to the floor of the safe, preferably a PEM® stud, also as seen in FIG. 7.

An inside, top perspective view of the safe 300 is shown in FIG. 7 where the mounting stud 353 can be seen passing through a slot 352*b* cut into the slideable platform 352 and secured with fastener 354. The fastener is preferably a lock nut but can alternatively be a wingnut for release without the use of tools. In FIG. 7, the slideable platform 352 is shown in a first hinge pin blocking position. To remove the doors from the safe 300, a safe door must first be opened to allow access to the fastener 354. Once the nut is loosened, the slideable platform 352 can be slid out from underneath the hinge pin 316. It will be noted that slideable platform 352 and fastener 354 are collectively one example of a mechanism blocking access to the hinge pin when secured in a first position and providing access to the hinge pin 316 when released and moved to a second position.

Figure 8:
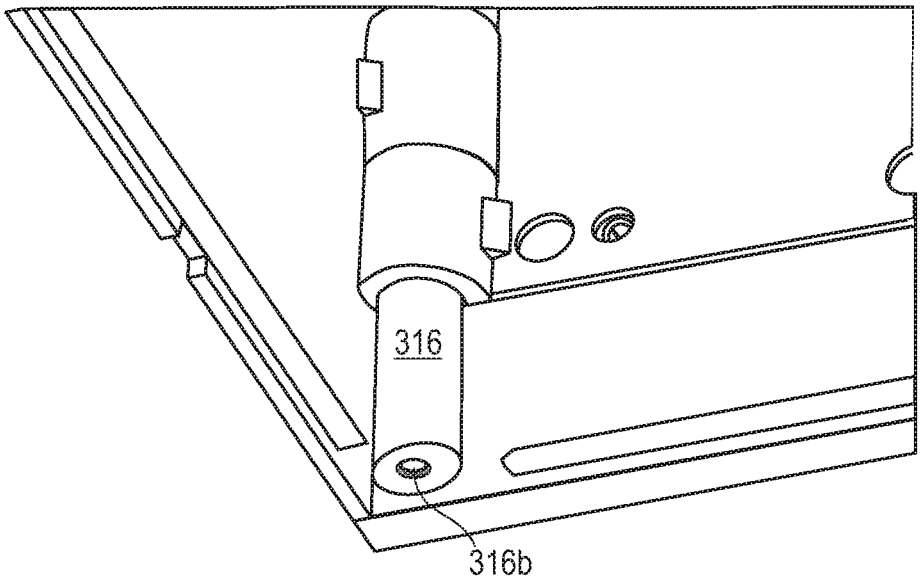

In FIG. 8, the bottom plate and slideable platform are shown removed to illustrate a drilled and tapped hole 316*b* in the bottom of the hinge pin 316. With the platform no longer blocking access to the bottom of the hinge pin, an operator is free to thread a removal tool into hole 316*b* on the bottom of hinge pin 316. The removal tool is preferably a ¼-20 bolt and a pliers for applying a downward force on the bolt. The bolt is one example of a removal mechanism which mates with the tapped hole.

In order to pull the hinge pin completely out of the safe, the safe must be lifted off its base. Electronic drop safes are typically bolted to the floor for added security using a set of floor anchors. These anchors therefore need to be removed prior to removing the hinge pin which requires access inside the safe. For a burglar to successfully remove the hinge pin from a locked safe, they must first pry the safe off the floor defeating the anchors and then drill through the slideable platform. Since the hinge pin 316 only has a tapped hole on the bottom, it would be very difficult to pull the pin out of the safe through the top surface which is more accessible to a burglar. The top of the safe also lacks a pre-drilled hole to gain access to the hinge pin. Such drilling or other efforts to improperly access the hinge pin could be detected as addressed by the enhanced security features taught by U.S. Patent Application Publication No. 2011/0279225A1, assigned to the assignee of the present application, and incorporated by reference herein in its entirety.

Figure 9:
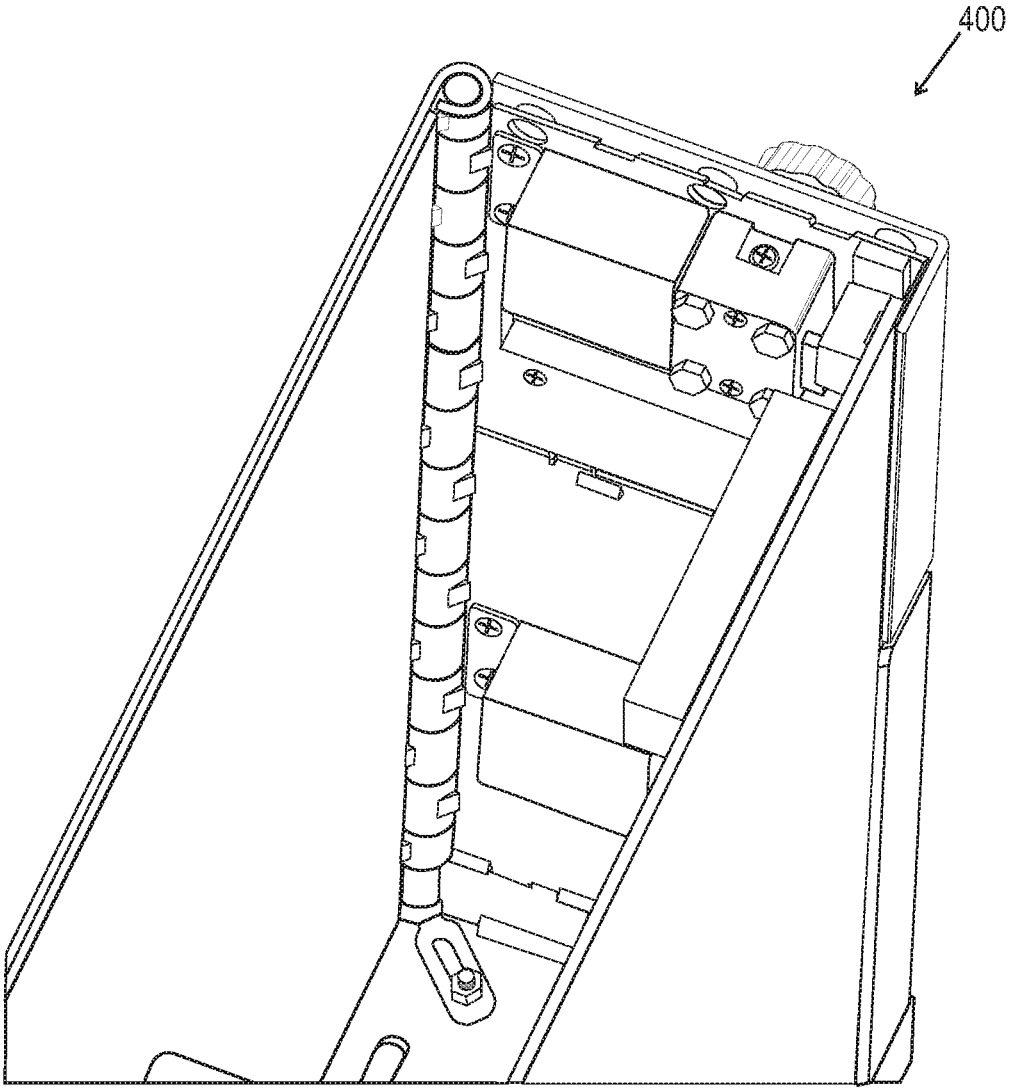
FIG. 9 shows an alternate embodiment of a hinged electronic drop safe design having a smaller form factor.

FIG. 9 shows an alternate embodiment of the hinge on a smaller model safe 400.

While the invention has been described in the context of several presently preferred embodiments, it is to be understood that the words which have been used are words of description rather than of limitation and that changes may be made within the purview of the appended claims without departing from the true scope and spirit of the invention in its broader aspects. By way of example, while the invention is described primarily in the context of electronic drop safes with two or more safe doors, it will be recognized that advantages of the present invention may also be realized in the context a wide variety of safes where aesthetics and resistance to vandalism are important including single door safes. Rather, various modifications may be made in the details within the scope and range of equivalents of the claims without departing from the spirit of the invention.

We claim:

1. A safe comprising:

at least one door having an integrally formed first set of knuckles; and a side wall having an integrally formed second set of knuckles mating with said integrally formed first set of knuckles of the at least one door;

a hinge pin;

a hole in a base of the safe aligned with the hinge pin; and a mechanism blocking access to a bottom end of the hinge pin when secured in a first position and providing access to the bottom end of the hinge pin when released and moved to a second position, wherein no exterior welds are made to reinforce either the first set of knuckles or the second set of knuckles and the hinge pin is removable through the hole when the blocking mechanism is released and moved to a second position.

2. The safe of claim 1, further comprising:

a top piece which upon installation secures the hinge pin from top access.

3. The safe of claim 2, wherein the safe is an electronic safe employing a bill validator and stacker, and the at least one door further comprises a first bill validator access door and a second stacker access door.

4. The safe of claim 1, wherein the safe is an electronic safe employing a bill validator and stacker, and said at least one door comprises a first bill validator access door and a second bill stacker access door.

5. The safe of claim 1 further comprising a series of internal welds to strengthen the first set of knuckles by securing them to an inner surface of the at least one door.

6. The safe of claim 1 further comprising a series of internal welds to strengthen the second set of knuckles.

7. The safe of claim 1 wherein the mechanism blocking access is a slideable plate secured interiorly of the safe in a location accessible through the at least one door.

8. The safe of claim 7 wherein the slideable plate is secured by a mounting stud fastened to an interior floor of the safe.

9. The safe of claim 7 wherein the slideable plate has a slot.

10. The safe of claim 1 wherein the hinge pin has a tapped hole for receiving a removal mechanism which mates with the tapped hole to facilitate removal of the hinge pin.

* * * * *